US005510314A

United States Patent [19]

Evans et al.

[11] Patent Number: 5,510,314

[45] Date of Patent: Apr. 23, 1996

[54] THERMAL DYE TRANSFER SYSTEM WITH RECEIVER CONTAINING REACTIVE CARBONYL GROUP

[75] Inventors: Steven Evans; Kristine B. Lawrence, both of Rochester; Ellen J. Pyszczek, Leroy, all of N.Y.

[73] Assignee: Eastman Kodak Company, Rochester, N.Y.

[21] Appl. No.: 410,195

[22] Filed: Mar. 24, 1995

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS

| | | | |
|---|---|---|---|
| 4,614,521 | 9/1986 | Niwa et al. | 430/201 |
| 4,695,286 | 9/1987 | Vanier et al. | 8/471 |

FOREIGN PATENT DOCUMENTS

| | | | |
|---|---|---|---|
| 5-212981 | 8/1993 | Japan | 503/227 |
| 5-238174 | 9/1993 | Japan | 503/227 |

*Primary Examiner*—B. Hamilton Hess
*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, the dye being substituted with a reactive primary or secondary aliphatic amino group, and (b) a dye-receiving element comprising a support having thereon a dye image-receiving layer, the dye-receiving element being in a superposed relationship with the dye-donor element so that the dye layer is in contact with the dye image-receiving layer, the dye image-receiving layer comprising a polymer containing a plurality of functional groups:

$R^2$—CO—X—$R^3$ wherein:
$R^2$ represents alkyl, aryl, alkoxy or aryloxy;
X represents oxygen or sulfur; and
$R^3$ represents aryl or hetaryl;
with the proviso that $R^2$ or $R^2$ and $R^3$ are directly attached to the polymer chain.

11 Claims, No Drawings

THERMAL DYE TRANSFER SYSTEM WITH RECEIVER CONTAINING REACTIVE CARBONYL GROUP

This invention relates to a thermal dye transfer system, and more particularly to the use of a thermal dye transfer assemblage wherein the receiver contains a reactive carbonyl group which reacts with amino-substituted dyes transferred from a dye-donor element.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints and plastic folders, generally referred to as retransfer.

Many of the deficiencies of thermal dye transfer systems with regard to the above features can be traced to insufficient immobilization of the dye in the receiver polymer. It would be desirable to provide a dye/receiver polymer system in which the dye is capable of undergoing reaction with the receiver polymer to form a dye species with reduced mobility, preferably via covalent attachment to the polymer chain.

U.S. Pat. No. 4,614,521 relates to a reactive dye-polymer system for thermal dye transfer imaging. Specifically, this patent discloses a variety of dyes having substituents capable of reacting with receiver polymers having epoxy or isocyanate groups. However, there is a problem with receivers containing epoxy- or isocyanate-containing polymers in that they are potentially prone to poor keeping, especially in humid environments.

Japanese Patent Application JP05-238174 relates to the thermal transfer of dyes, substituted with groups having "alkaline" properties, to an image receiving material containing an "acidic" substance. Dye-receiver binding is the result of an acid-base reaction between the basic dye and the acidic substance in the receiver, which yields a dye salt (ion-pair) rather than a covalent reaction product. However, there is a problem with these dyes in that they are potentially unstable in acidic environments, especially in combination with atmospheric moisture.

Japanese Patent Application JP05-212981 relates to the thermal transfer of dyes having an "active hydrogen", such as a primary amino group, to a receiver layer having a basic catalyst and an "active olefin", such as an acrylate or acrylamide polymer. The basic catalysts include metal alkoxides and Grignard compounds. A Michael-type addition of the active hydrogen-containing group of the dye to the olefinic group in the receiver yields a covalently bound dye. However, there is a problem with acrylate-type materials in that they are potentially prone to light and dark chemical changes which could reduce the effectiveness of the binding reaction.

It is an object of this invention to provide a thermal dye transfer system having improved retransfer properties.

This and other objects are achieved in accordance with this invention which relates to a thermal dye transfer assemblage comprising:

(a) a dye-donor element comprising a support having thereon a dye layer comprising a dye dispersed in a polymeric binder, the dye being substituted with a reactive primary or secondary aliphatic amino group, and (b) a dye-receiving element comprising a support having thereon a dye image-receiving layer, the dye-receiving element being in a superposed relationship with the dye-donor element so that the dye layer is in contact with the dye image-receiving layer, the dye image-receiving layer comprising a polymer containing a plurality of functional groups:

$$R^2—CO—X—R^3$$

wherein:

$R^2$ represents alkyl, aryl, alkoxy or aryloxy;

X represents oxygen or sulfur; and $R^3$ represents aryl or hetaryl;

with the proviso that $R^2$ or $R^2$ and $R^3$ are directly attached to the polymer chain.

Any type of polymer may be employed in the receiver e.g., condensation polymers such as polyesters, polyurethanes, polycarbonates, etc.; addition polymers such as polystyrenes, vinyl polymers, etc.; block copolymers containing large segments of more than one type of polymer covalently linked together and having the reactive carbonyl group in any or all of the segments such as a poly(dimethylsiloxane)-polyacrylate block copolymer with the reactive groups located in the acrylate block, the poly(dimethylsiloxane) block or in both segments, etc.

It has been found that dyes substituted with reactive primary or secondary aliphatic amino groups give much improved retransfer performance, as compared to dyes without such substituents, when transferred to receiving elements based on polymers containing carbonyl groups capable of reacting with the amino groups to form amide bonds.

In a preferred embodiment of the invention, the dyes employed have the general formula:

$$A—L—NHR^1$$

wherein:

A represents a thermally transferable dye residue, e.g., any of the dye classes described in the art for use in thermal transfer imaging such as azo, methine, merocyanine, indoaniline, anthraquinone, etc.;

L represents a divalent alkylene linking group of 1–10 carbon atoms, which may be substituted or interrupted with other divalent moieties such as oxygen atoms, carbonyl groups etc.; and $R^1$ represents H or an alkyl group of 1 to 10 carbon atoms, which may also optionally be bonded to either A or L.

Dyes according to the above formula are disclosed in Japanese Patent Application JP05-212981, the disclosure of which is hereby incorporated by reference.

Receiver polymers according to the above formula are disclosed in U.S. Pat. No. 4,695,286, the disclosure of which is hereby incorporated by reference.

The reaction of the dye and polymer leads to polymer bound dyes of the structure:

$$R^2—CO—NR^1—L—A \text{ and/or } R^3—X—CO—NR^1—L—A$$

where A, L, X, $R^1$, $R^2$, and $R^3$ are as described above.

The following dyes may be used in accordance with the invention:

Dye 1

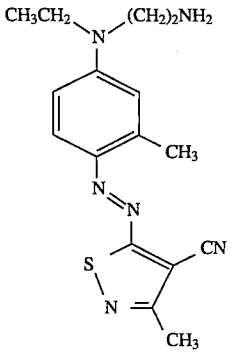

Dye 2

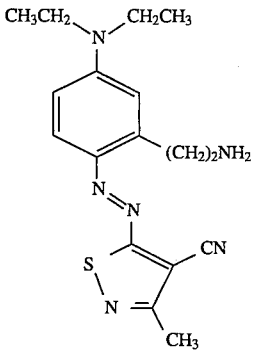

Dye 3

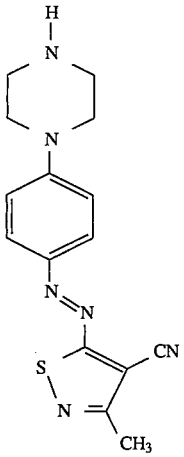

-continued

Dye 4

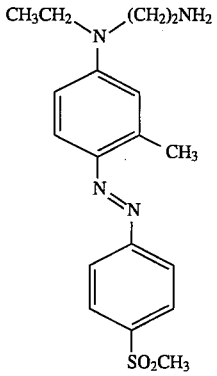

Dye 5

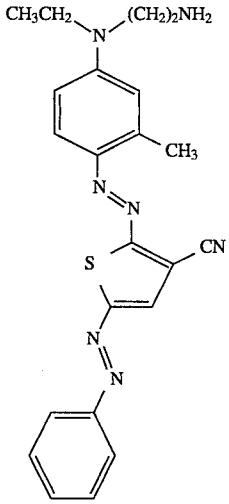

Dye 6

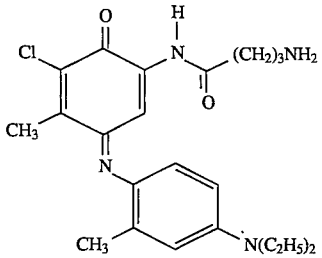

Dye 7

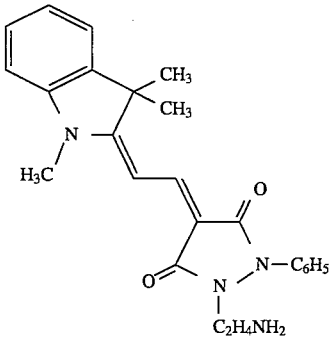

-continued

Dye 8

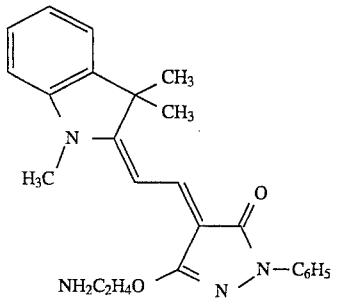

The following receiver polymers may be used in accordance with the invention:

Polymer 1: Lexan ® 141-112 (General Electric Co.)

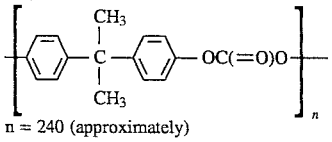

n = 240 (approximately)

Polymer 2: KL3-1013 (Miles Laboratories)

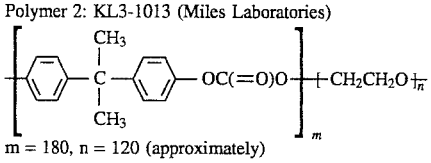

m = 180, n = 120 (approximately)

Polymer 3:

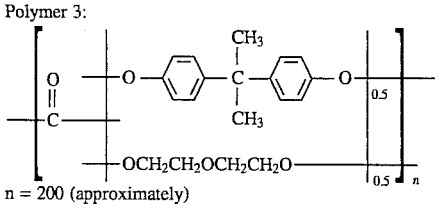

n = 200 (approximately)

Polymer 4:

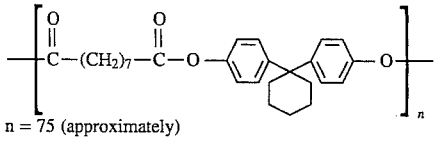

n = 75 (approximately)

Polymer 5:

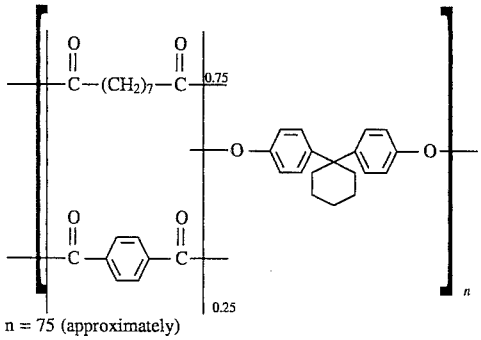

n = 75 (approximately)

Polymer 6: Poly(phenyl methacrylate)
(Scientific Polymer Products Inc.Catalogue No. 227)

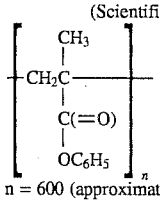

n = 600 (approximately)

The polymer in the dye image-receiving layer may be present in any amount which is effective for its intended purpose. In general, good results have been obtained at a mordant concentration of from about 0.5 to about 10 g/m$^2$. The above polymers can be prepared by techniques similar to those decribed in U.S. Pat. Nos. 4,927,803; 5,302,574 and 5,244,862.

The support for the dye-receiving element of the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference.

Resistance to sticking during thermal printing may be enhanced by the addition of release agents to the dye-receiving layer or to an overcoat layer, such as silicone based compounds, as is conventional in the art.

Dye-donor elements that are used with the dye-receiving element of the invention conventionally comprise a support having thereon a dye-containing layer as described above.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of a cyan, magenta and yellow dye, as described above, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following example is provided to further illustrate the invention.

EXAMPLE

Dyes

The following control dyes were synthesized and evaluated:

1. Control dyes with basic substituents other than primary or secondary aliphatic amines. These dyes are typical of those described in Japanese Patent Application JP05-238174.

Dye C-1

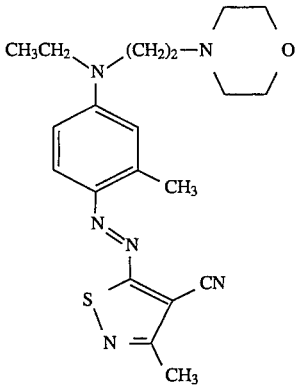

Dye C-2

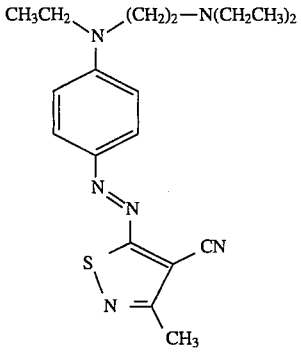

Dye C-3

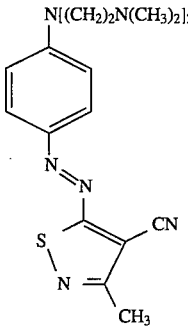

-continued

Dye C-4

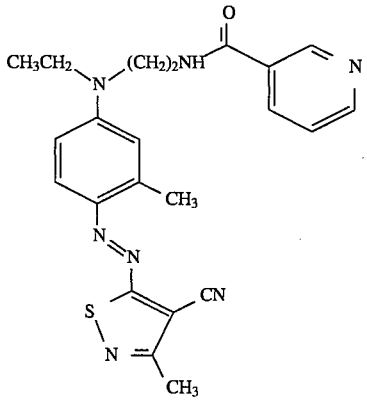

Dye C-13

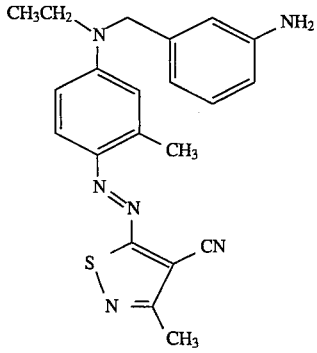

2. Control dyes with substituents other than amines that have active hydrogens. These dyes are typical of those described in Japanese Patent Application JP05-212981 and/or U.S. Pat. No. 4,614,521.

Dye C-5

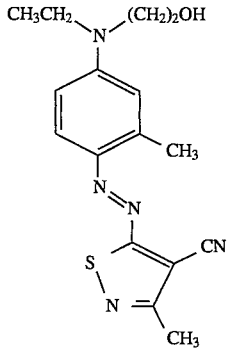

C-6

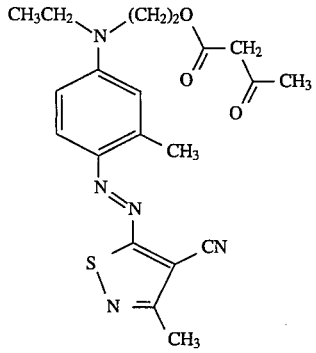

3. Control dyes with substituents having no basic properties or active hydrogens.
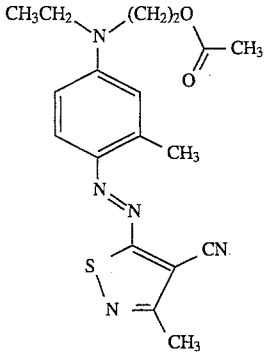
Dye C-7
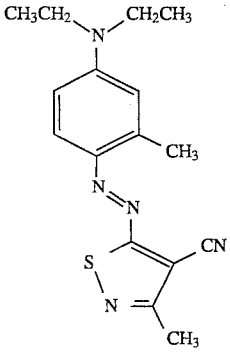
Dye C-8
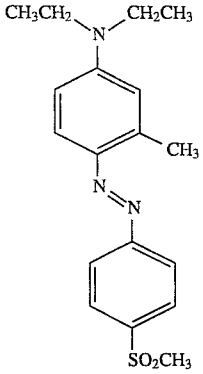
Dye C-9
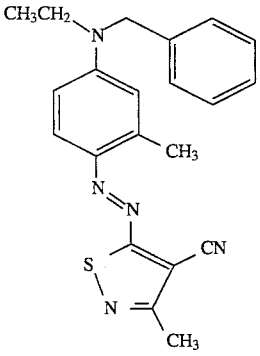
Dye C-10
-continued
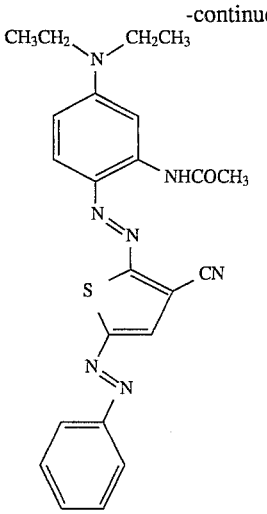
Dye C-11
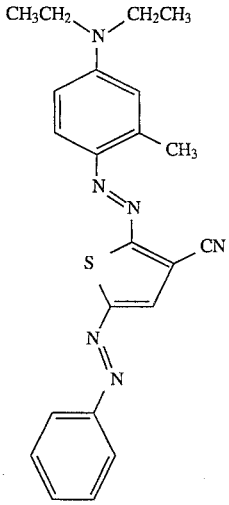
Dye C-12
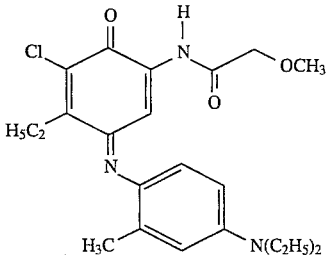
Dye C-14
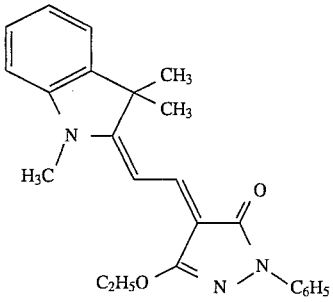
Dye C-15

-continued

Dye C-16

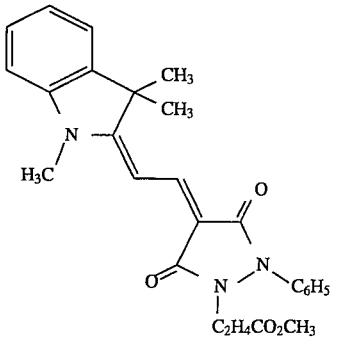

Polymeric Dye-receiving Layers.

The following control polymers which do not contain reactive groups conforming to the invention structure were coated and evaluated as dye receiver layers below:

Polymer C-1:

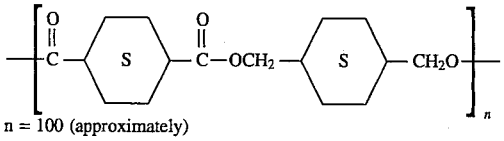

n = 100 (approximately)

Polymer C-2:

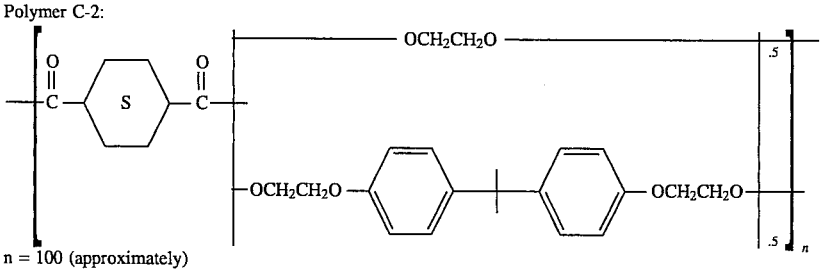

n = 100 (approximately)

Polymer C-3:

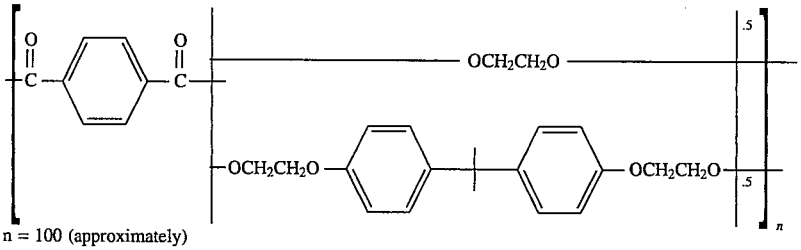

n = 100 (approximately)

Polymer C-4: Butvar B-76 (Monsanto)

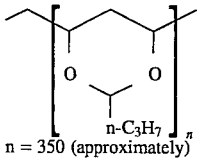

n = 350 (approximately)

Polymer C-5:

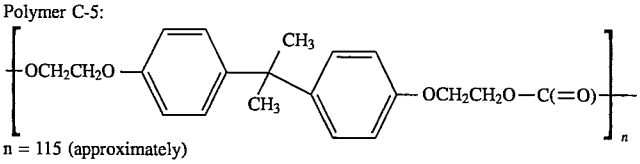

n = 115 (approximately)

Polymer C-6:

-continued

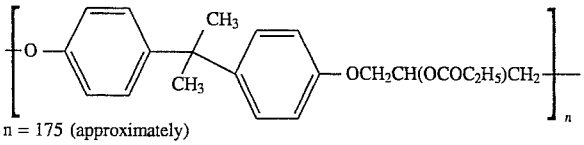

n = 175 (approximately)

Polymer C-7:

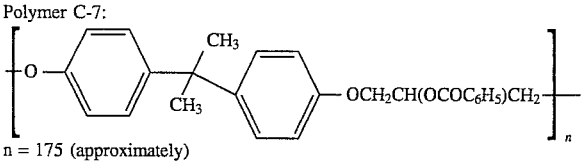

n = 175 (approximately)

Polymer C-8:

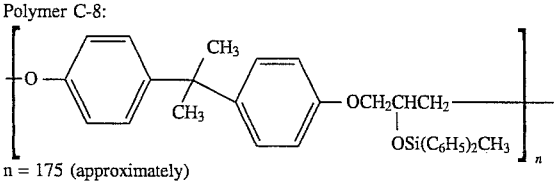

n = 175 (approximately)

Preparation Of Dye-Donor Elements

Dye-donor elements 1–8 and Control Dye-donor elements C-1 to C-16 were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol; and 2) a dye layer containing dyes 1-8 of the invention and control dyes C-1 to C-16 described above, and FC-431® fluorocarbon surfactant (3M Company) (0.01 g/m$^2$) in a cellulose acetate propionate binder (2.5% acetyl, 45% propionyl) coated from a toluene, methanol and cyclopentanone mixture.

Details of dye and binder laydowns are tabulated in Table 1 below.

On the back side of the dye-donor element was coated:

1) a subbing layer of Tyzor TBT®, a titanium tetrabutoxide, (DuPont Company) (0.16 g/m$^2$) coated from 1-butanol; and 2) a slipping layer of Emralon 329® (Acheson Colloids Co.), a dry film lubricant of poly(tetrafluoroethylene) particles in a cellulose nitrate resin binder (0.54 g/m$^2$) and S-nauba micronized carnauba wax (0.016 g/m$^2$) coated from a n-propyl acetate, toluene, isopropyl alcohol and n-butyl alcohol solvent mixture.

TABLE 1

| Dye Donor Element | λ-max* | Dye Laydown (g/m$^2$) | CAP** (g/m$^2$) |
|---|---|---|---|
| 1 | 552 | 0.20 | 0.22 |
| 2 | 551 | 0.22 | 0.25 |
| 3 | 534 | 0.23 | 0.25 |
| 4 | 460 | 0.48 | 0.63 |
| 5 | 632 | 0.23 | 0.17 |
| 6 | 653 | 0.54 | 0.39 |
| 7 | 463 | 0.23 | 0.30 |
| 8 | 446 | 0.31 | 0.41 |
| C-1 | 551 | 0.23 | 0.25 |
| C-2 | 543 | 0.22 | 0.23 |
| C-3 | 541 | 0.23 | 0.26 |
| C-4 | 547 | 0.26 | 0.29 |
| C-5 | 549 | 0.20 | 0.22 |
| C-6 | 541 | 0.26 | 0.28 |
| C-7 | 539 | 0.26 | 0.26 |

TABLE 1-continued

| Dye Donor Element | λ-max* | Dye Laydown (g/m$^2$) | CAP** (g/m$^2$) |
|---|---|---|---|
| C-8 | 549 | 0.18 | 0.20 |
| C-9 | 458 | 0.44 | 0.59 |
| C-10 | 542 | 0.23 | 0.27 |
| C-11 | 628 | 0.26 | 0.19 |
| C-12 | 629 | 0.23 | 0.17 |
| C-13 | 547 | 0.23 | 0.27 |
| C-14 | 662 | 0.48 | 0.35 |
| C-15 | 445 | 0.30 | 0.39 |
| C-16 | 464 | 0.21 | 0.28 |

*measured in acetone solution
**cellulose acetate propionate

Preparation and Evaluation of Dye-Receiver Elements

As one dye-receiver element, (Receiver Element 1, Table 2) of the invention, commercially available Kodak P3000 thermal printing paper was utilized and evaluated as described below. This material is prepared by extrusion laminating a paper core with a 38 μ thick microvoided composite film (OPPalyte 350TW®, Mobil Chemical Co.) as disclosed in U.S. Pat. No. 5,244,861. The composite film side of the resulting laminate was then coated with the following layers in the order recited:

1) a subbing layer of an aminoalkylene aminotrimethoxysilane (Z-6020, Dow Corning Co., 0.11 g/m$^2$) coated from ethanol;

2) a dye-receiving layer composed of a mixture of two bisphenol A polycarbonates: Polymer 1 above (1,453 g/m$^2$) and Polymer 2 above (1.776 g/m2), dibutyl phthalate (0,323 g/m2), diphenyl phthalate (0,323 g/m$^2$) and a fluorocarbon surfactant (Fluorad FC-431®, 3M Corporation, 0,011 g/m$^2$) coated from dichloromethane; and 3) an overcoat layer of a linear condensation co-polycarbonate of bisphenol A (50 mole %), diethylene glycol (49 mole %) and a poly(dimethylsiloxane) block unit (MW =2500, 1 mole %), Fluorad FC-431® (0.02 g/m$^2$) and a silicone fluid (DC510, Dow Corning) coated from dichloromethane.

Additional dye-receiver elements (see Table 2 for details) were prepared by coating on the composite film laminated paper core support described above the following layers in the order recited:

1) a subbing layer of Polymin Waterfree® polyethyleneimine (BASF, 0.02 g/m2), and
2) a dye-receiving layer of the polymers of the invention or control polymers described above (3.23 g/m2), a fluorocarbon surfactant (Fluorad FC-431®, 3M Corporation, 0,011 g/m$^2$) and, optionally, dibutyl phthalate (0.323 g/m$^2$) and diphenyl phthalate (0,323 g/m$^2$) as plasticizers coated from an appropriate solvent.

TABLE 2

| Dye-Receiver Elements | | | |
|---|---|---|---|
| Receiver Element | Polymer(s) | Plasticizer | Coating Solvent[1] |
| 1 (Kodak P3000 thermal print paper) | 1 + 2 (see Example 1) | Yes | A |
| 2 | 1 + 2 (1:1.22) | Yes | B |
| 3 | 2 | No | A |
| 4 | 3 | No | A |
| 5 | 4 | No | A |
| 6 | 5 | No | A |
| 7 | 6 | No | A |
| C-1 | C-1 | No | A |
| C-2 | C-2 | No | A |
| C-3 | C-3 | No | A |
| C-4 | C-4 | No | C |
| C-5 | C-5 | No | A |
| C-6 | C-6 | No | A |
| C-7 | C-7 | No | A |
| C-8 | C-8 | No | A |
| C-9 | C-9 | No | A |

[1]A: dichloromethane
B: dichloromethane/trichloroethylene (4:1)
C: toluene/methanol/cyclopentanone (67:28:5)

Preparation and Evaluation of Thermal Dye Transfer Images

Eleven-step sensitometric thermal dye transfer images were prepared from the above dye-donor and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head (TDK No. 8I0625, thermostatted at 31° C.) was pressed with a force of 24.4 newtons (2.5 kg) against the dye-donor element side of the assemblage, pushing it against the rubber roller.

The imaging electronics were activated causing the donor-receiver assemblage to be drawn through the printing head/roller nip at 11.1 mm/s. Coincidentally, the resistive elements in the thermal print head were pulsed (128 μs/pulse) at 129 μs intervals during a 16.9 μs/dot printing cycle. A stepped image density was generated by incrementally increasing the number of pulses/dot from a minimum of 0 to a maximum of 127 pulses/dot. The voltage supplied to the thermal head was approximately 10.25 v resulting in an instantaneous peak power of 0.214 watts/dot and a maximum total energy of 3.48 mJ/dot.

After printing, the dye-donor element was separated from the imaged receiving element and the appropriate (red, green or blue) Status A reflection density of each of the eleven steps in the stepped-image was measured with a reflection densitometer. The reflection density at the highest power is listed in Table 3.

A second eleven-step image adjusted to yield a maximum density of approximately 2.5–3.0 by varying the printing voltage over the range of 9.5 v–11.5 v (see Table 2) was prepared as above. The imaged side of the stepped image was placed in intimate contact with a similarly sized piece of a poly(vinyl chloride) (PVC) report cover, a 1 kg weight was placed on top and the whole assemblage was incubated in an oven held at 50° C. for 1 week. The PVC sheet was separated from the stepped image and the amount of dye transferred to the PVC and the severity of the degradation of the uniformity of the stepped image were noted. The ratings for these criteria are collected in Table 3. In each case, a relative ranking of 0–5 was assigned, with 0 representing no dye transferred to the PVC and no image degradation and 5 representing essentially complete dye transfer and nearly total image degradation. The following results were obtained:

TABLE 3

| Dye/Receiver Performance | | | | | |
|---|---|---|---|---|---|
| Dye Donor Element | Dye Receiver Element | D-max[1] | Print Voltage | Dye Transferred to PVC | Image Uniformity After Incubation |
| 1 | 1 | 2.7 | 10.25 | 2 | 2 |
| 2 | 1 | 2.1 | 11.0 | 2 | 3 |
| 3 | 1 | 2.9 | 10.25 | 2 | 2 |
| 4 | 1 | 1.7(B) | 10.25 | 1 | 1 |
| 5 | 1 | 2.7(R) | 10.25 | 1 | 2 |
| 1 | 2 | 2.7 | 10.25 | 2 | 2 |
| 1 | 3 | 2.2 | 10.75 | 2 | 1 |
| 6 | 1 | 0.8(R) | 12.0 | 1 | 2 |
| 7 | 1 | 1.6(B) | 10.25 | 1 | 0 |
| 8 | 1 | 2.3(B) | 10.25 | 1 | 1 |
| C-1 | 1 | 2.8 | 10.25 | 5 | 5 |
| C-2 | 1 | 2.8 | 10.25 | 5 | 4 |
| C-3 | 1 | 2.9 | 10.25 | 5 | 5 |
| C-4 | 1 | 1.8 | 10.25 | 3 | 5 |
| C-5 | 1 | 2.8 | 9.75 | 5 | 5 |
| C-6 | 1 | 3.0 | 10.25 | 4 | 4 |
| C-7 | 1 | 3.0 | 9.75 | 5 | 5 |
| C-7 | 2 | 3.2 | 10.25 | 5 | 5 |
| C-7 | 3 | 2.8 | 10.25 | 5 | 5 |
| C-8 | 1 | 3.0 | 9.5 | 5 | 5 |
| C-9 | 1 | 2.0(B) | 10.25 | 5 | 5 |
| C-10 | 1 | 3.1 | 9.75 | 5 | 5 |
| C-11 | 1 | 2.6(R) | 10.25 | 5 | 5 |
| C-12 | 1 | 2.8(R) | 9.75 | 4 | 5 |
| C-13 | 1 | 2.2 | 10.75 | 5 | 5 |
| C-14 | 1 | 2.7(R) | 9.5 | 5 | 5 |
| C-15 | 1 | 2.7(B) | 10.25 | 5 | 5 |
| C-16 | 1 | 2.0(B) | 10.25 | 5 | 5 |
| 1 | C-1 | 2.4 | 10.75 | 4 | 4 |
| C-7 | C-1 | 2.6 | 10.25 | 5 | 5 |
| 1 | C-2 | 2.5 | 10.75 | 5 | 4 |
| C-7 | C-2 | 2.8 | 10.25 | 5 | 5 |
| 1 | C-3 | 2.3 | 10.75 | 4 | 4 |
| C-7 | C-3 | 2.9 | 10.25 | 5 | 5 |
| 1 | C-4 | 2.2 | 10.75 | 5 | 5 |
| C-7 | C-4 | 2.4 | 10.75 | 5 | 5 |
| 1 | C-5 | 2.7 | 10.25 | 5 | 5 |
| 1 | C-6 | 2.5 | 10.25 | 5 | 5 |
| 1 | C-7 | 2.5 | 10.25 | 5 | 5 |
| 1 | C-8 | 2.4 | 10.5 | 5 | 5 |

[1]Status A Green (G) Reflection Density, except as noted. B = blue, R = red.

As the results in Table 3 clearly show, the use of dyes with reactive amino groups and dye-receiving layers based on polymers containing carbonyl groups capable of reacting with the amino groups yields thermal dye transfer images with good transferred density and superior resistance to damage from contact with other surfaces.

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being substituted with a reactive primary or secondary aliphatic amino group, and (b) a dye-receiving element comprising a support having thereon a dye image-receiving layer, said dye-receiving element being in a superposed relationship with said dye-donor element so that said dye layer is in contact with said dye image-receiving layer, said dye image-receiving layer comprising a polymer containing a plurality of functional groups:

$$R^2—CO—X—R^3$$

wherein:

$R^2$ represents alkyl, aryl, alkoxy or aryloxy;

X represents oxygen or sulfur; and $R^3$ represents aryl or hetaryl; with the proviso that $R^2$ or $R^2$ and $R^3$ are directly attached to the polymer chain.

2. The assemblage of claim 1 wherein said dye has the general formula:

$$A—L—NHR^1$$

wherein:

A represents a thermally transferable dye residue;

L represents a divalent alkylene linking group of 1–10 carbon atoms, which may optionally be substituted or interrupted with other divalent moieties; and $R^1$ represents H or an alkyl group of 1 to 10 carbon atoms, which may also optionally be bonded to either A or L.

3. The assemblage of claim 2 wherein A is the residue of an azo dye, an indoaniline dye or a merocyanine dye.

4. The assemblage of claim 2 wherein L is an alkylene group of from 2 to 4 carbon atoms.

5. The assemblage of claim 2 wherein $R^1$ is hydrogen.

6. A process of forming a dye transfer image comprising imagewise-heating a dye-donor element comprising a support having thereon a dye layer comprising a dye dispersed in a polymeric binder, said dye being substituted with a reactive primary or secondary aliphatic amino group, and imagewise transferring said dye to a dye-receiving element to form said dye transfer image, said dye-receiving element comprising a support having thereon a dye image-receiving layer, said dye image-receiving layer comprising a polymer containing a plurality of functional groups:

$$R^2—CO—X—R^3$$

wherein:

$R^2$ represents alkyl, aryl, alkoxy or aryloxy;

X represents oxygen or sulfur; and $R^3$ represents aryl or hetaryl; with the proviso that $R^2$ or $R^2$ and $R^3$ are directly attached to the polymer chain.

7. The process of claim 6 wherein said dye has the general formula:

$$A—L—NHR^1$$

wherein:

A represents a thermally transferable dye residue;

L represents a divalent alkylene linking group of 1–10 carbon atoms, which may optionally be substituted or interrupted with other divalent moieties; and $R^1$ represents H or an alkyl group of 1 to 10 carbon atoms, which may also optionally be bonded to either A or L.

8. The process of claim 7 wherein A is the residue of an azo dye, an indoaniline dye or a merocyanine dye.

9. The process of claim 7 wherein L is an alkylene group of from 2 to 4 carbon atoms.

10. The process of claim 7 wherein $R^1$ is hydrogen.

11. The process of claim 6 wherein polymer bound dyes are formed having the structure:

$$R^2—CO—NR^1—L—A \text{ and/or } R^3—X—CO—NR^1—L—A$$

wherein:

A represents a thermally transferable dye residue;

L represents a divalent alkylene linking group of 1–10 carbon atoms, which may optionally be substituted or interrupted with other divalent moieties;

X represents oxygen or sulfur; $R^1$ represents H or an alkyl group of 1 to 10 carbon atoms, which may also be optionally be bonded to either A or L, $R^2$ represents alkyl, aryl, alkoxy or aryloxy; and $R^3$ represents aryl or hetaryl.

* * * * *